US005882068A

United States Patent [19]

Levine

[11] Patent Number: 5,882,068

[45] Date of Patent: Mar. 16, 1999

[54] FOLDING RECLINING CHAIR APPARATUS

[75] Inventor: Eric R. Levine, Highland Mills, N.Y.

[73] Assignee: Coastal Sales Associates, Inc., Harriman, N.Y.

[21] Appl. No.: 46,363

[22] Filed: Mar. 23, 1998

[51] Int. Cl.[6] ..... A47C 4/50

[52] U.S. Cl. ..... 297/21; 247/16.2

[58] Field of Search ..... 297/16.1, 16.2, 297/18, 19, 21, 374

[56] References Cited

U.S. PATENT DOCUMENTS

| | | | |
|---|---|---|---|
| 617,661 | 1/1899 | Smith | 297/18 |
| 1,422,319 | 7/1922 | Stoll | 297/16.2 X |
| 1,789,404 | 1/1931 | Grams | 277/21 |
| 3,124,387 | 3/1964 | Maclaren . | |
| 3,136,272 | 6/1964 | Sprigman . | |
| 4,421,356 | 12/1983 | Singer . | |
| 4,685,725 | 8/1987 | Helfrich . | |
| 5,320,404 | 6/1994 | Le Gal . | |
| 5,340,193 | 8/1994 | Wolf . | |
| 5,415,455 | 5/1995 | Geldbaugh . | |

FOREIGN PATENT DOCUMENTS

| | | | |
|---|---|---|---|
| 1255449 | 1/1961 | France | 297/19 |

OTHER PUBLICATIONS

What–A–Chair Advertisement, Jul. 25, 1995.

*Primary Examiner*—Peter R. Brown
*Attorney, Agent, or Firm*—Schmeiser, Olsen & Watts

[57] ABSTRACT

A folding reclining chair includes a frame portion, having frame members that connect foot joints to seat joints; a seat portion joined to the seat joints; and a back portion in sliding engagement with two seat joints and joined to slide-lock mechanisms engaged with frame members, such that the back portion is adapted to being selectively reclined. For example, the frame portion may include pairs of frame members that are pivotally joined at a point between a first end and a second end of each of the two frame members in a pair, with the first end and second end of each frame member pivotally joined to a seat joint and a foot joint, respectively. Also for example, the seat portion may include a seat rest formed by a sheet of flexible material joined to a seat joint and engaged with the back portion.

6 Claims, 9 Drawing Sheets

FOLDING RECLINING CHAIR APPARATUS

BACKGROUND OF THE INVENTION

1. Technical Field

This invention generally relates to reclining chairs, and more specifically to a transportable folding reclining chair.

2. Background Art

Today, folding chairs are used in numerous outdoor and indoor activities ranging from camping, hiking and fishing to painting, sporting events, concerts, and parties. Many of the portable, collapsible seats which have previously been developed do not have a back supports, or if they do, the support is in a fixed position.

Many of the previously described activities require a large amount of time spent seated in one location. For example, an artist painting a landscape will remain in the same position for numerous hours to retain the same perspective, lighting, and feel for the trees, mountain or general landscape that they are painting. People fishing will stay in the same position for many hours waiting for a bite, being careful not to cause shadows or identify themselves to the fish. These activities cause a great strain on a user's back from constant sitting without properly adjusted back support.

Conventional folding chairs, like the traditional three legged camp chair, do not have a back support. They do not provide a mechanism for creating better sitting posture or back support. Those folding chairs that do have back support tend to be more cumbersome to set up and have relatively few reclining positions.

A traditional type of reclining chair is a beach lounger. This has two or more rectangular frames that are pivotally connected. One rectangular frame has a seat portion connected to it while the other has a number of notches cut from it, that are used in conjunction with a locking member, to position the seat frame at different angles relative to the notched base. This traditional recliner is extremely cumbersome since the size of the rectangular frame is constant, the material used is traditionally wood or metal, thereby creating a heavier recliner. This type of recliner also has a limited number of reclining positions.

Other recliners do not fair much better than the traditional beach lounger. Pool loungers or recliners have a similar design to those of beach chairs, however they do solve the weight problem when made from aluminum or the like. Unfortunately, pool loungers are far from transportable and again have a limited number of back support positions.

It is therefore necessary to develop a collapsible recliner that avoids these described limitations. Specifically, by being light weight, easily collapsible, easily transportable and allowing numerous reclining positions to allow a user to have personalized back support.

DISCLOSURE OF INVENTION

According to the present invention, a folding reclining chair is disclosed. A folding reclining chair according to a preferred embodiment of the present invention includes:

a) a frame portion, having frame members that connect foot joints to seat joints;

b) a seat portion joined to at least one seat joint; and c) a back portion in sliding engagement with at least one seat joint and joined to at least one sliding mechanism engaged with at least one frame member, such that the back portion is adapted to being selectively reclined.

For example, the frame portion may include pairs of frame members that are pivotally joined at a point between a first end and a second end of each of the two frame members in a pair, with the first end and second end of each frame member pivotally joined to a seat joint and a foot joint, respectively. Also for example, the seat portion may include a seat rest formed by a sheet of flexible material joined to a seat joint and engaged with the back portion. Also for example, the back portion may include:

a) a plurality of back frame members, each positioned within an aperture of a seat joint that is adapted to slidably engage the back frame member at a point between a first end and a second end of the back frame member;

b) a slide mechanism that is a slide-lock mechanism for positioning the back frame members at an adjustable, substantially obtuse angle with respect to the seat portion, each slide-lock mechanism being in sliding engagement with one frame member, being pivotally joined to the second end of a back frame member, and having a lever adapted to locking the slide-lock mechanism in an adjustable position on the frame member; and c) a back rest formed by a sheet of flexible material joined to a plurality of the back frame members.

Preferably, the folding reclining chair includes four pairs of frame members, four seat joints, four foot joints, two back frame members, and two slide-lock mechanisms. Such a preferred folding reclining chair essentially resembles a four-legged chair that may be collapsed into a folded state and selectively reclined.

In summary, with a configuration according to the present invention the folding reclining chair has a mechanism for folding and a mechanism for reclining the back portion to a variety of desired positions.

BRIEF DESCRIPTION OF DRAWINGS

Preferred embodiments of the present invention will hereinafter be described in conjunction with the appended drawings, where like designations denote like elements, and.

BEST MODE FOR CARRYING OUT THE INVENTION

In accordance with the present invention, a folding reclining chair provides a mechanism for folding and a mechanism for reclining the back portion to a variety of desired positions. Preferably, such chair essentially resembles a four-legged chair that may be collapsed into a folded state and selectively reclined, however, other configurations are conceivable using the elements of the present invention.

Figure 1:
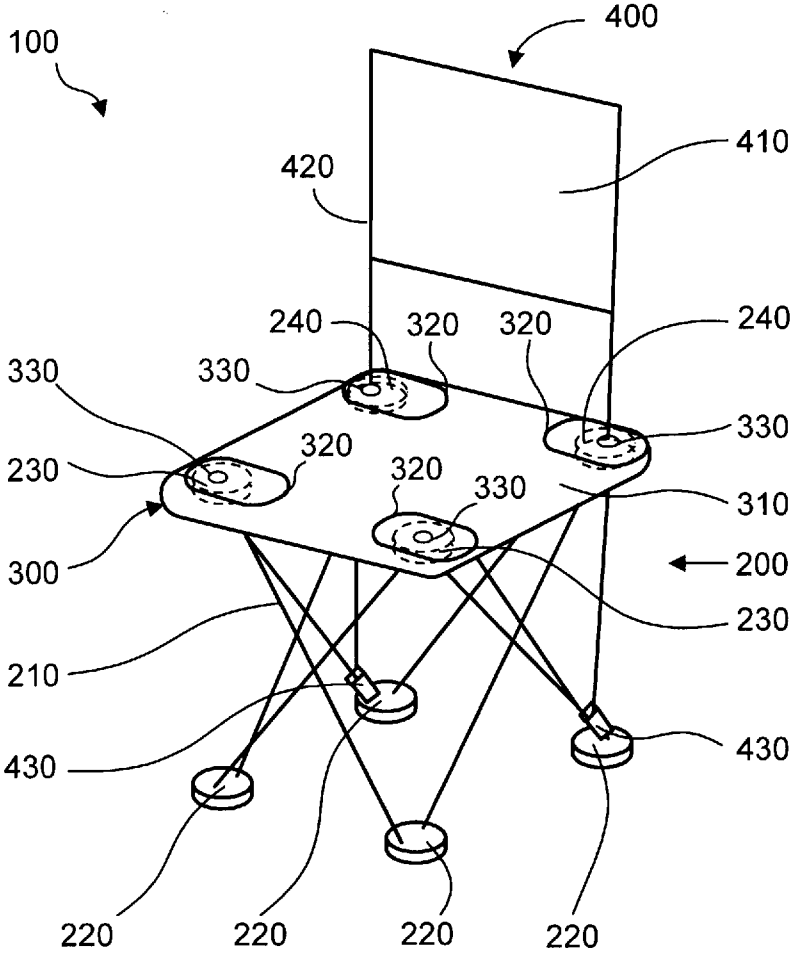
FIG. 1 is a perspective view of a reclining folding chair.
Figure 3B:
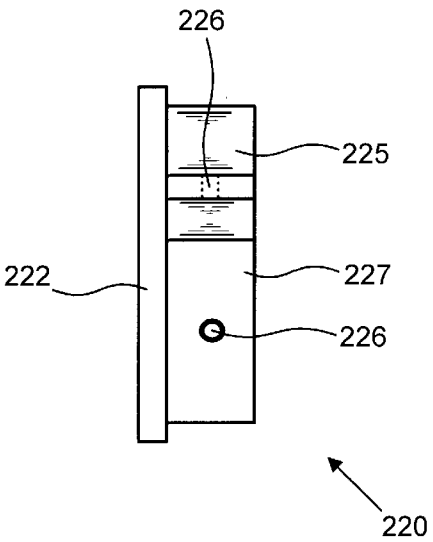
FIGS. 3*a* and 3*b* are a side view and a top view, respectively, of a foot joint from the chair of FIG. 1.
Figure 3A:
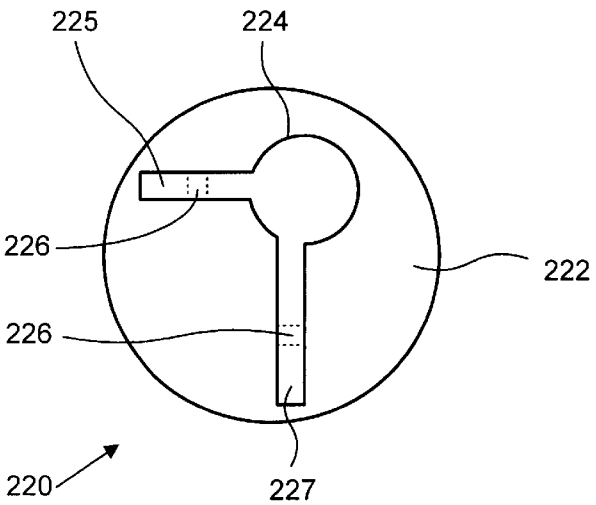
Figure 4:
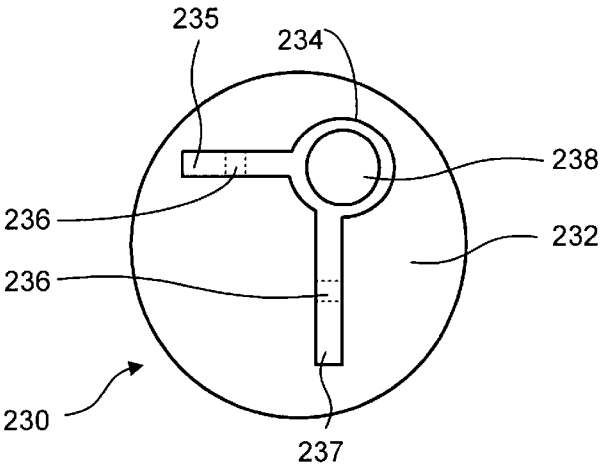
FIG. 4 is a bottom view of a seat joint from the chair of FIG. 1.
Figure 6:
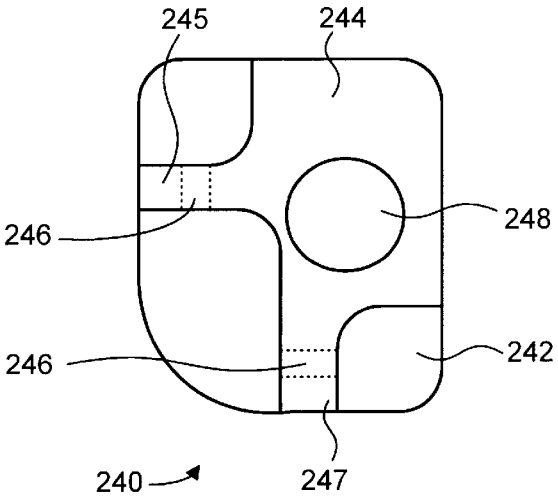
FIG. 6 is a bottom view of a sliding seat joint from the chair of FIG. 1.

Referring now to FIG. 1, a folding chair 100 according to a preferred embodiment of the present invention has a frame portion 200, a seat portion 300 and a reclining back portion 400. Frame portion 200 includes: eight frame members 210, four foot joints 220, two seat joints 230, and two sliding seat joints 240. Seat portion 300 includes: a seat rest 310, four strengthening portions 320, and four grommets 330. Back portion 400 includes: a back rest 410, two back frame members 420, and two sliding/locking mechanisms 430.

Frame portion 200 is assembled by connecting four pairs of coupled frame members 210 to a number of foot joints 220, seat joints 230 and sliding seat joints 240, forming a generally cuboidal structure. To assemble seat portion 300, seat rest 310 is connected to frame portion 200 and back portion 400 by coupling two grommets 330 to seat joints 230 and sliding back frame members 420 through the other two grommets 330. To assemble back portion 400, two back frame members 420 are inserted through sliding seat joints 240 and secured into sliding/locking mechanisms 430, while back rest 410 is secured to back frame members 420.

Figure 2:
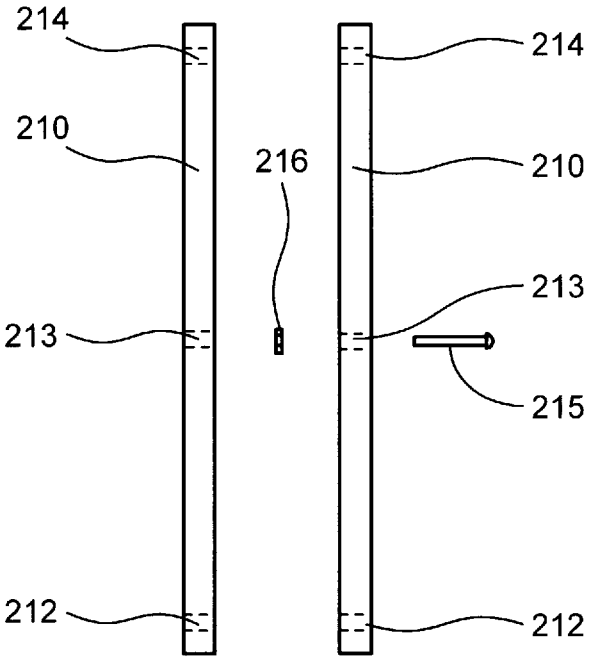
FIG. 2 is an exploded side view of a pair of connected frame members from the chair of FIG. 1.

Turning to FIG. 2, a frame member 210 includes securing holes 212, 213 and 214 located near the ends and middle of frame member 210. Formation of frame portion 200 includes coupling a pair of frame members 210 together by inserting and securing a fastener 215 through holes 213. Fastener 215 is selected and positioned in holes 213 such that it forms a rotatable connection between the pair of frame members 210. Placing a divider 216 between the pair of frame members 210 assists in smooth rotation of frame members 210 about fastener 215. A washer through which fastener 215 passes is generally suitable for divider 216. FIG. 1 shows how four pairs of frame members 210 are coupled to foot and seat joints 220, 230, and 240 to form frame portion 200 that has a generally cuboidal structure. Each pair of frame members 210 define one vertical side of the generally cuboidal structure and foot and seat joints 220, 230, and 240 define the corners of the cuboid.

The cross-sectional area of frame member 210 may be rectangular, circular, elliptical, or any other suitable shape. Fastener 215 may be a nut and bolt assembly or any other suitable mechanism for securely joining the components of frame portion 200. Typical materials used to fabricate frame member 210, joints 220, 230, and 240 include steel, aluminum, composite material, fibreglass, molded polymers or any other materials known to those skilled in the art that will give sufficient strength and rigidity to support a person seated on reclining folding chair 100.

As indicated in FIGS. 3–7, foot joint 220 includes a platform 222, a connecting member 224, and two frame joining holes 226. Seat joint 230 includes a platform 232, a connecting member 234, a seat rest joining hole 238, and two frame joining holes 236. Sliding seat joint 240 includes a platform 242, a connecting member 244, an angled sliding aperture 248, and two frame joining holes 246. Foot and seat joints 220, 230, and 240 are preferably unitary devices formed from a single material, although they could also be formed by attaching connecting members 224, 234, or 244 to platforms 222, 232, or 242. For example, connecting members 224, 234, or 244 could be glued, welded, or otherwise attached to platforms 222, 232, or 242.

Figure 7:
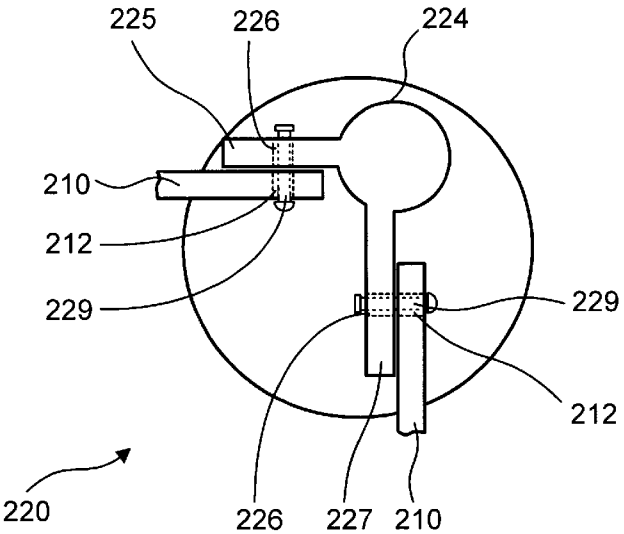
FIG. 7 is a top view of a foot joint pivotally joined to frame members from the chair of FIG. 1.
Figure 5:
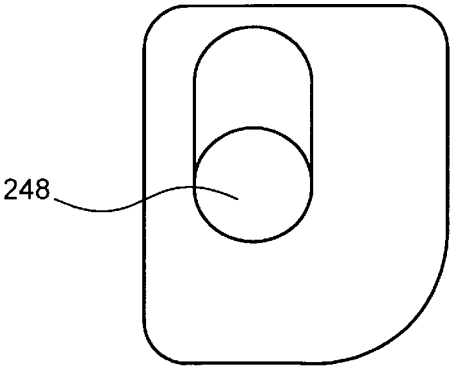
FIG. 5 is a top view of a sliding seat joint from the chair of FIG. 1.

Connecting member 224 has two arms 225 and 227 that have joining holes 226 through them. Connecting members 234 and 244 similarly have two arms 235, 237 and 245, 247 with joining holes 236 and 246, respectively. Joining holes 226, 236, and 246 are used to fasten frame members 210 to foot and seat joints 220, 230, and 240. Foot and seat joints 220, 230, and 240 connect each pair of frame members 210 to an adjoining pair of frame members 210 by means of a fastener inserted through joining holes 226, 236, and 246 and end securing holes 212 or 214 in frame members 210. For example, FIG. 7 shows a fastener 229 inserted through end securing holes 212 of frame members 210 and through joining holes 226 of connecting member 224 for foot joint 220. Each joint 220, 230, and 240 has two frame members 210 coupled to it in similar fashion.

Figure 8:
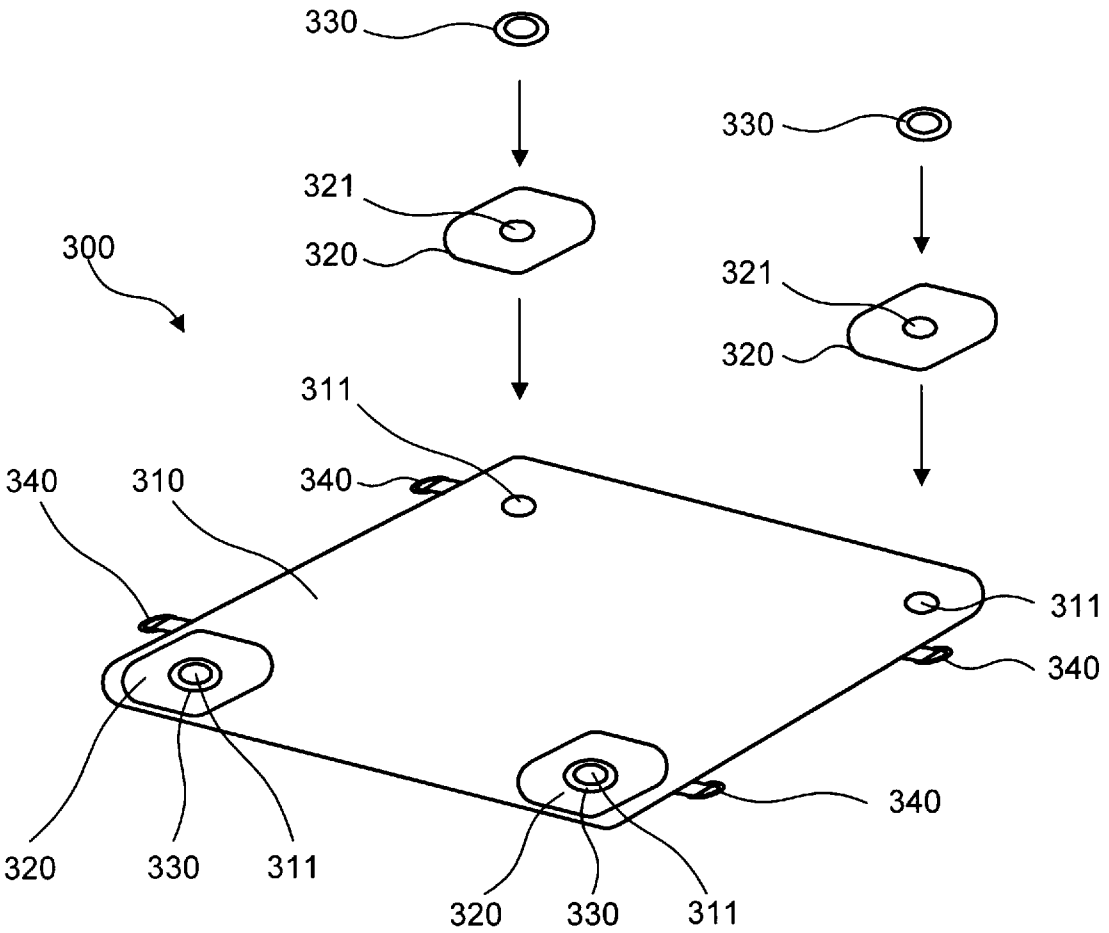
FIG. 8 is an exploded perspective view of the seat portion the chair of FIG. 1.

Referring now to FIG. 8, seat portion 300 comprises a seat rest 310, a number of strengthening portions 320, a number of grommets 330, and a number of attachment loops 340. Seat rest 310 is formed with a series of four holes 311 located at the comers. Strengthening portion 320 is formed with a hole 321 located through it. To form seat portion 300, seat rest 310 has four strengthening portions 320 attached to it and aligned to have hole 311 coincident with hole 321. Four grommets 330 are then coupled through holes 311 and 321 to give additional strength and support and to stop seat rest 310 from ripping when a user sits on reclining folding chair 100. At least one attachment loop 340 is attached to seat rest 310. Attachment loop 340 may be as simple as a loop of material for attaching a food or beverage pouch to the edge of seat rest 310. Also, attachment loop 340 could include a hook and loop configuration with hooks attached to one edge of seat rest 310 and loops attached to the opposite edge, thereby allowing a number of recliners to be connected in a row next to each other.

Various embodiments of seat portion 300 are conceivable. Any other types of seat rest 310 that are sufficiently flexible to be folded yet possess the strength sufficient to seat a user, are applicable. In addition, other mechanisms for strengthening seat rest 310 and stopping ripping of seat rest 310 are applicable. Typical materials for seat rest 310 and strengthening portion 320 include leather, canvas, nylon, synthetic materials, polymers, or any material that provides flexibility, durability and strength. Grommets 330 may be manufactured from steel, aluminum, carbon fibre, composite materials, polymers or other material that will not deform or break when a user sits in the chair.

Figure 9:
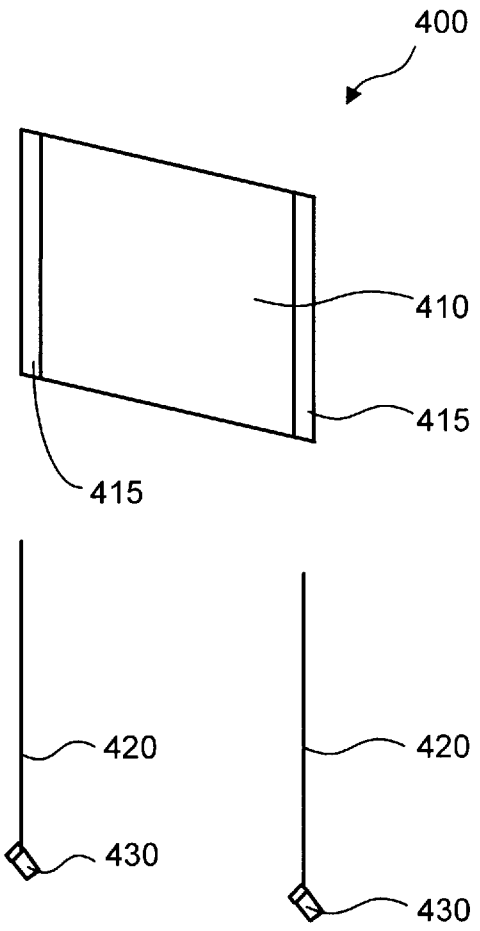
FIG. 9 is an exploded perspective view of the back portion of the chair of FIG. 1.

Referring now to FIG. 9, back portion 400 includes back rest 410, back frame members 420, and sliding/locking mechanisms 430. Back rest 410 has a generally rectangular shape and a number of parallel sleeves 415 adapted for receiving two back frame members 420 to form back portion 400. Sliding/locking mechanisms 430 are located at the opposite end of back frame members 420.

Referring now to FIGS. 10–13, a sliding/locking mechanism 430 includes a sliding body 432 and a cam lever 435. Sliding body 432 has a channel 439 adapted for receiving cam lever 435 and back frame member 420 and a tube 437 adapted for receiving frame member 210. Cam lever 435 has one end suitable for acting as a lever 438 and another end resembling the shape of an eccentric cam 439. Joining holes 436 are located at the eccentric cam 439 end of cam lever 435 and in the sides of channel 439. A portion of the floor of channel 439 is cut away from the sides of channel 439 to form a tongue brake 440.

To assemble sliding/locking mechanism 430, sliding body 432 is coupled to frame member 210 such that frame member 210 slides within tube 437. Cam lever 435 is slotted into channel 439 until joining holes 436 coincide. Fastener 450 is passed through joining holes 436 to couple cam lever 435 to sliding body 432. Back frame member 420 is coupled to sliding body 432 in a similar fashion with fastener 450 inserted through other joining holes 436.

Figure 12:
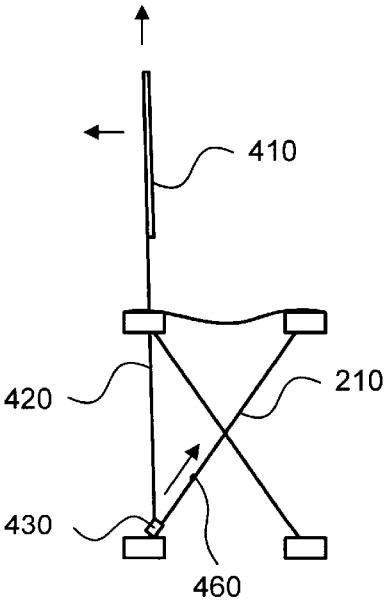
FIG. 12 is a side view of the direction of movement of sliding/locking mechanism in the chair of FIG. 1.
Figure 13:
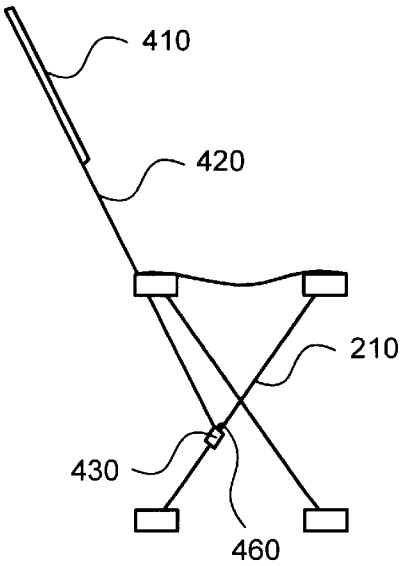
FIG. 13 is a side view of the final position after movement of sliding/locking mechanism in the chair of FIG. 1.

To use sliding/locking mechanism 430 to position reclining back portion 400, cam lever 435 is released by rotating lever 438 about the axis of fastener 450 securing cam lever 435 until cam end 439 is no longer in contact with tongue brake 440. Once released, sliding body 432 is moved along frame member 210 to reach a desired position. Movement of sliding/locking mechanism 430 causes back rest 410 both to recline and to extend as shown in FIGS. 12 and 13. That is, sliding/locking mechanism 430 moves both upward and frontward as it slides along frame member 210, causing back rest both to recline backward and extend upward. The extent of the reclining and extending depends upon the length and position of frame member 210 which, in turn, depends upon the design of frame portion 200. Accordingly, frame portion 200 may be designed such that back rest 410 moves from the shoulder area of a typical user when upright to the head area of a user when reclined. Once positioned, sliding/locking mechanism 430 is locked into position when cam shaped lever 435 is again rotated about the axis of fastener 450 until cam end 439 comes into contact with tongue brake 440, depressing tongue brake 440 against frame member 210. Tongue brake 440 is preferably shaped such that it corresponds to the shape of frame member 210. Such a corresponding shape provides an increased surface area of tongue brake 440 to contact frame member 210, improving the grip of sliding/locking mechanism 430.

Stopping mechanism 460 limits the range of movement of sliding/locking mechanism 430 to the path between foot joint 220 joined to frame member 210 and stopping mechanism 460. In this embodiment, stopping mechanism 460 is simply a screw threaded into frame member 210. Other configurations include nuts and bolts, indentations on the surface of frame member 210 or other such devices or methods.

Figure 10:
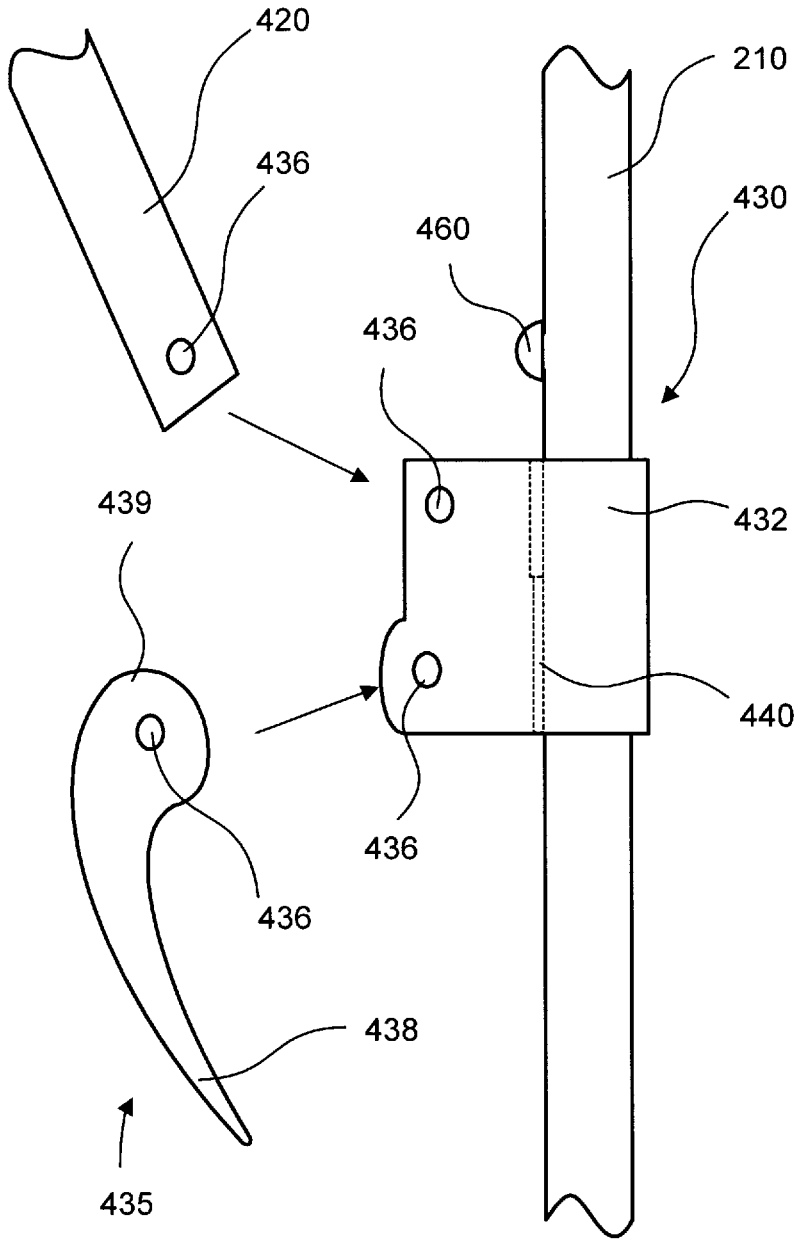
FIG. 10 is an exploded side view of the sliding/locking mechanism from the chair of FIG. 1.
Figure 11A:
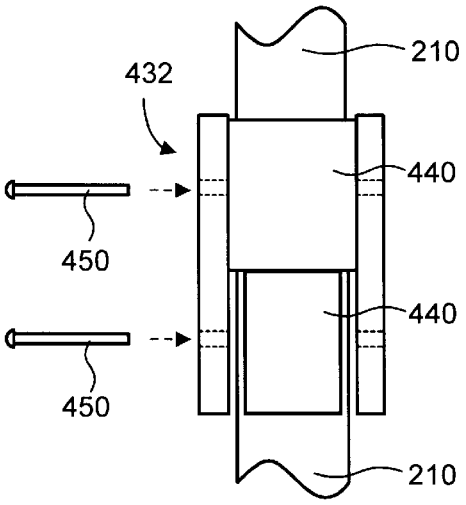
FIGS. 11*a* and 11*b* are a side view and end view of a sliding member of the sliding/locking mechanism from the chair of FIG. 1.
Figure 11B:
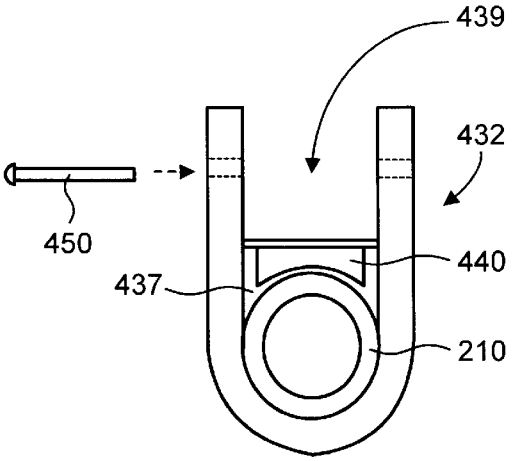

An alternative embodiment of sliding/locking mechanism 430 comprises a sliding body 432 without tongue brake 440. Rather, eccentric camn 439 directly contacts frame member 210 to lock sliding/locking mechanism 430 into a selected position. In this alternative embodiment, eccentric cam 439 is preferably shaped to correspond to the shape of frame member 210, as with tongue brake 440 shown in FIG. 11*b*, such that an adequate grip is maintained. However, a "flat" cam without a conforming shape as shown in FIG. 10, may be used provided it applies sufficient pressure to grip frame member 210 when in the locked position.

The cross-section of back frame member 420 may be rectangular, circular, elliptical, or any other suitable shape. Typically, back frame member 420 is made of the same materials as frame members 210, that is, solid or tubular steel, aluminum, carbon fiber, fibreglass, polymers or other materials that arc sufficiently rigid, strong and durable to support a users back. Back rest 410 may be of any shape and any flexible material that may be folded and yet supports a users back. Some shapes include, but are not limited to triangular, trapezoidal, square, semicircular or elliptical. Typical materials include, but are not limited to leather, canvas, nylon, synthetic materials and polymers.

Figure 14:
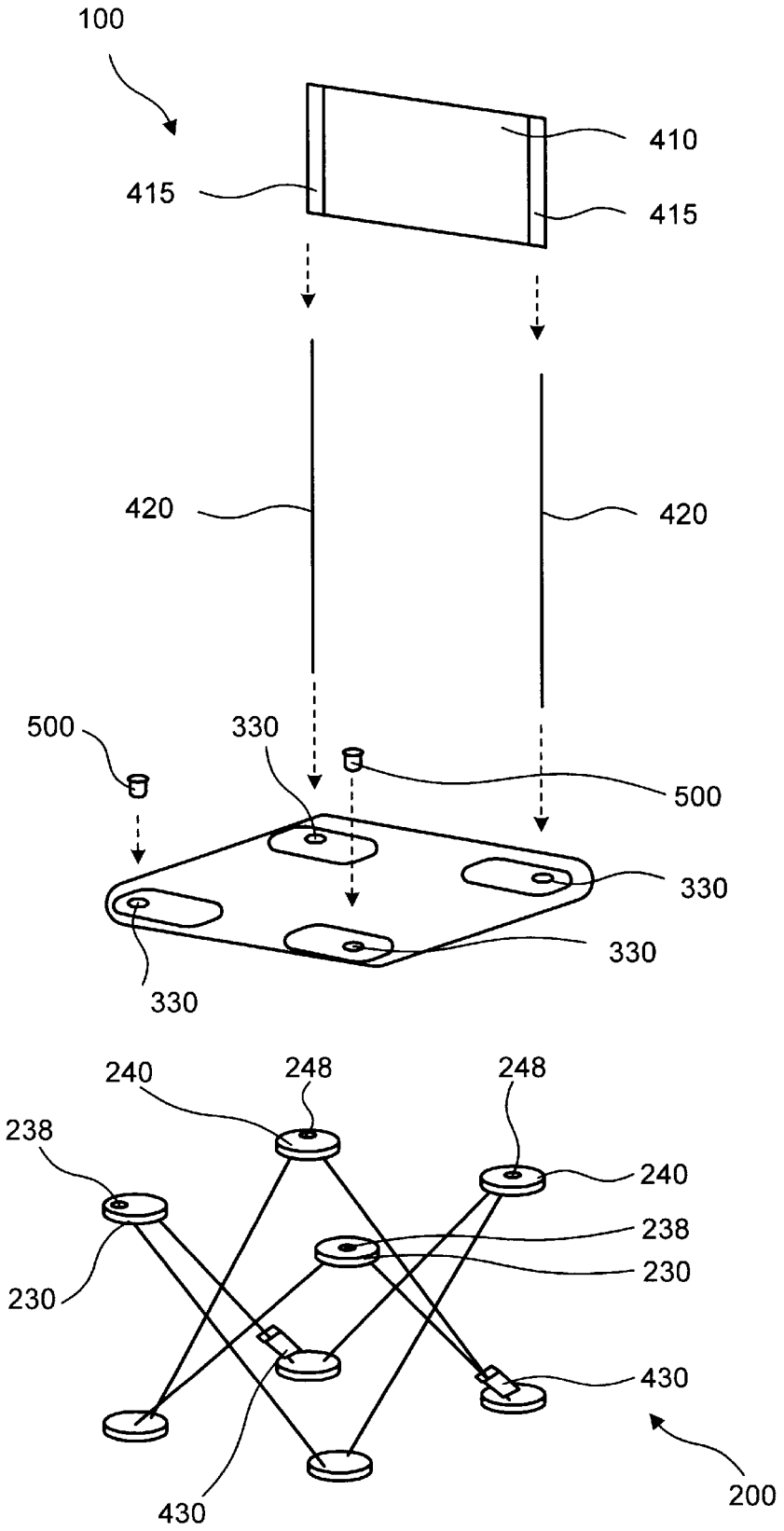
FIG. 14 is an exploded perspective view of elements used in the chair of FIG. 1.
Figure 15:
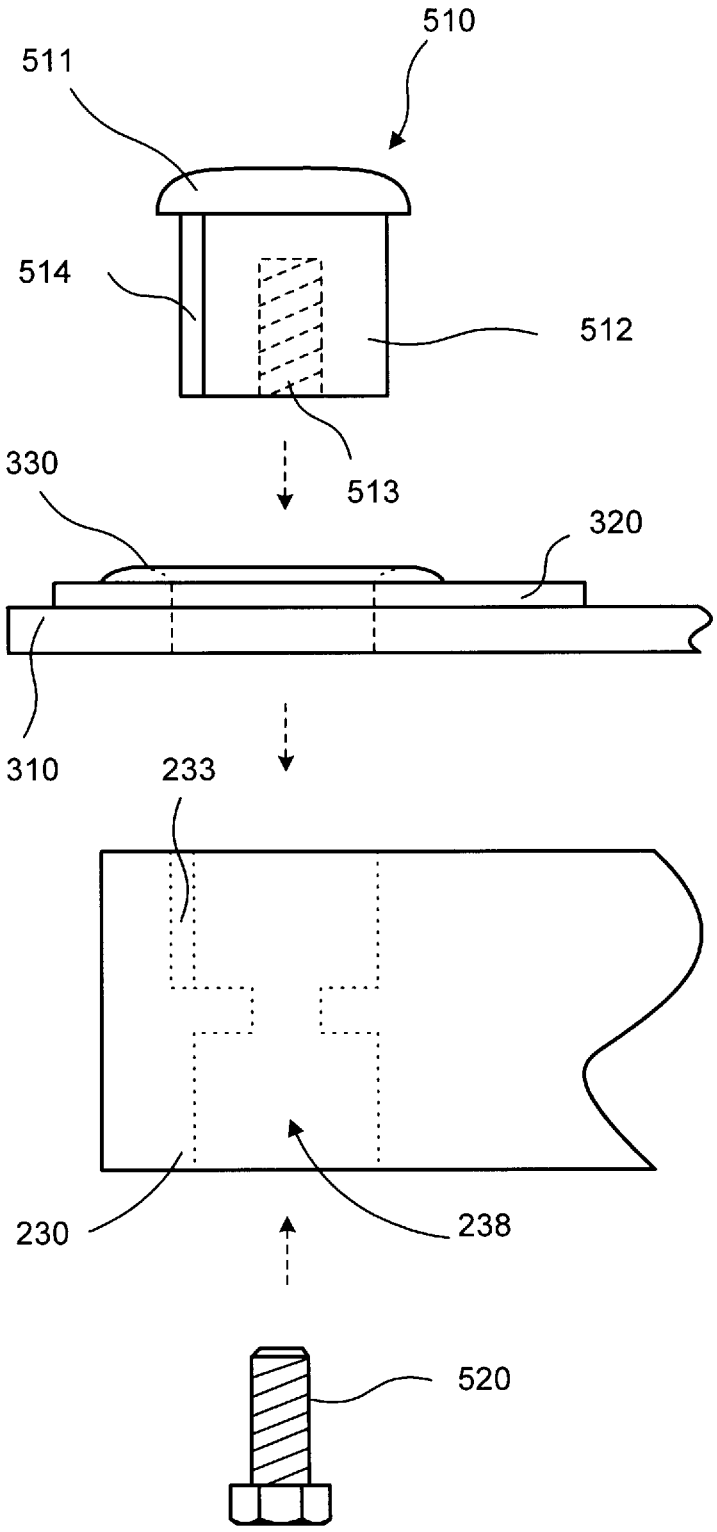
FIG. 15 is an exploded side view of an embodiment of a fastener used to connect the seat portion to the frame portion of the chair of FIG. 1.

Referring now to FIGS. 14–15, reclining folding chair 100 is assembled by first assembling frame portion 200 with a number of foot joints 220, seat joints 230, sliding seat joints 240 and frame members 210. Seat rest 310 is laid upon two seat joints 230 and two sliding seat joints 240 such that grommets 330 align with seat rest joining holes 238 and angled sliding apertures 248. Back frame members 420 are inserted through grommets 330 and angled sliding apertures 248 in sliding seat joints 240 and secured to sliding/locking mechanism 430. Back frame members 420 are inserted into sleeves 415 to secure back rest 410. A fastener 500 is inserted through grommet 330 and seat rest joining hole 238 of two seat joints 230 and tightened to secure seat portion 300 to frame portion 200.

Fastener 500 has a plastic nut 510 and a bolt 520. Plastic nut 510 further includes a head 511, a main body 512, and a threaded portion 513. Head 511 has a greater diameter than the diameter of grommet 330 to allow nut 510 to secure seat portion 300. Main body 512 has a ridge 514 that aligns with recess 233 of joining hole 238 to stop plastic nut 510 from rotating as bolt 520 is tightened into plastic nut 510. Any other suitable mechanism for securely joining seat portion 300 to frame portion 200 is appropriate.

Figure 16:
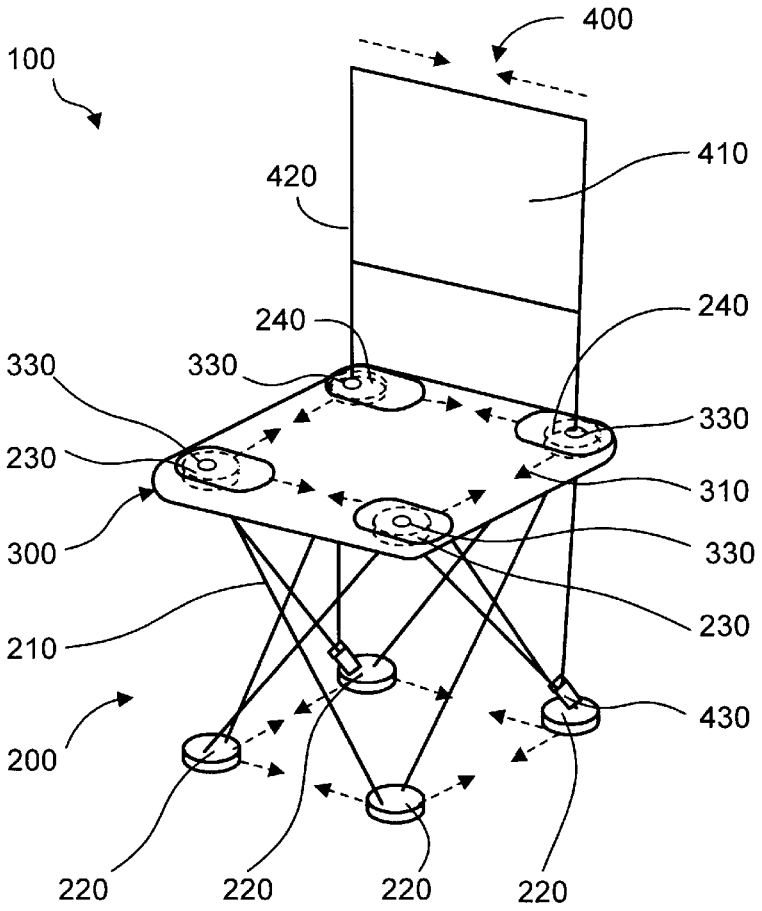
FIG. 16 is a perspective view of the method of collapsing folding chair of FIG. 1.
Figure 17:
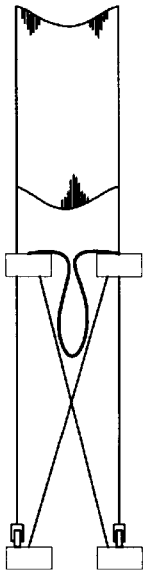
FIG. 17 is a front view of the folding chair in a collapsed state.
Figure 18:
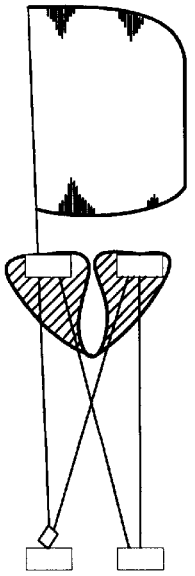
FIG. 18 is a side view of the folding chair in a collapsed state.

Referring now to FIGS. 16–18, folding reclining chair 100 is collapsed by pushing back frame members 420 together. As back frame members 420 move together, all frame members 210 rotate about fastener 215 shown in FIG. 2 and move foot joints 220 towards each other. At the same time, seat joints 230 and sliding seat joints 240 also move towards each other. Since both seat rest 310 and back rest 410 are flexible, they fold as the reclining folding chair 100 is collapsed.

While the invention has been particularly shown and described with reference to preferred embodiments thereof, it will be understood by those skilled in the art that various changes in form and details may be made therein without departing from the spirit and scope of the invention. Accordingly, unless otherwise specified, any dimensions of the apparatus indicated in the drawings or herein are given as an example of possible dimensions and not as a limitation. For example, while the invention has been described in terms of a four-footed chair, the principles of the invention described above are applicable to manufacture and assembly of reclining folding chairs with three or more feet. Similarly, unless otherwise specified, any sequence of steps of the method indicated in the drawings or herein are given as an example of a possible sequence and not as a limitation.

It is claimed:

1. An apparatus comprising:

a) a frame portion including:

1) a plurality of pairs of frame members, each of the two frame members in a pair being pivotally joined at a point between a first end and a second end of each of the two frame members;

2) three or more seat joints and three or more foot joints, wherein the first end of each frame member is pivotally joined to a seat joint and the second end of each frame member is pivotally joined to a foot joint;

b) a seat portion joined to the three or more seat joints; and c) a back portion including:

1) a plurality of back frame members, each positioned within an aperture of a seat joint that is adapted to slidably engage the back frame member at a point between a first end and a second end of the back frame member;

2) a plurality of slide-lock mechanisms for independently positioning each back frame member at an adjustable, substantially obtuse angle with respect to the seat portion, each slide-lock mechanism being in sliding engagement with one frame member joined to a rear foot joint and a front seat joint, being pivotally joined to the second end of a back frame member, and having a lever adapted to lock the slide-lock mechanism in an adjustable position on the frame member; and 3) a back rest formed by a sheet of flexible material joined to a plurality of the back frame members, wherein the arrangement of and connections between the frame portion, seat portion, and back portion are adapted to selectively collapsing the apparatus into a folded state.

2. The apparatus of claim 1, wherein the frame portion includes:

a) four pairs of frame members;

b) four seat joints; and c) four foot joints.

3. The apparatus of claim 1, wherein the seat portion includes:

a) a seat rest formed by a rectangular sheet of flexible material;

b) two fasteners each inserted through a hole formed in each of two corners of the seat rest joining the corners to two seat joints; and c) a hole formed in each of two other corners of the seat rest to provide a sliding engagement with the back portion.

4. The apparatus of claim 1, wherein the back portion includes:

a) two back frame members;

b) two slide-lock mechanisms; and c) a rectangular back rest with parallel sleeves adapted for receiving the back frame members to join the back rest thereto.

5. The apparatus of claim 1, wherein the slide-lock mechanism comprises a tube adapted for receiving the frame member and a sliding body adapted for receiving a cam lever and for pivotally joining the back frame member, wherein a first end of the cam lever is suitable for acting as a lever and a second end of the cam lever is substantially the shape of an eccentric cam.

6. The apparatus of claim 5, wherein the slide-lock mechanism additionally comprises a tongue brake for contacting the frame member to improve the grip of the slide-lock mechanism on the frame member compared to the eccentric cam alone.

* * * * *